US012653274B2

(12) United States Patent
Horton et al.

(10) Patent No.: US 12,653,274 B2
(45) Date of Patent: Jun. 16, 2026

(54) SHOE WITH REMOVABLE PARTS

(71) Applicants: Michael Horton, Tracy, CA (US); Valencia Burton, Tracy, CA (US)

(72) Inventors: Michael Horton, Tracy, CA (US); Valencia Burton, Tracy, CA (US)

(73) Assignees: Valencia Burton, Oakland, CA (US); Michael Horton, Oakland, CA (US)

( * ) Notice: Subject to any disclaimer, the term of this patent is extended or adjusted under 35 U.S.C. 154(b) by 0 days.

(21) Appl. No.: 17/675,354

(22) Filed: Feb. 18, 2022

(65) Prior Publication Data

US 2023/0263267 A1 Aug. 24, 2023

(51) Int. Cl.
*A43B 13/28* (2006.01)
*A43B 3/24* (2006.01)
*A43B 13/20* (2006.01)

(52) U.S. Cl.
CPC ..... *A43B 13/28* (2013.01); *A43B 3/24* (2013.01); *A43B 13/20* (2013.01)

(58) Field of Classification Search
CPC ..... A42B 13/28; A43B 3/24; A43B 3/244; A43B 13/36; A43B 13/20; A43B 17/18; A43B 23/029
USPC ..... 36/101, 100
See application file for complete search history.

(56) References Cited

U.S. PATENT DOCUMENTS 1,534,540 A * 4/1925 Pezzaniti ..... A43B 13/28 36/15
1,605,985 A * 11/1926 Rasmussen ..... A43B 13/20 36/153
2,367,232 A * 1/1945 Marx ..... A43B 3/24 36/15
3,807,061 A * 4/1974 Krus ..... A43C 15/162 36/114
4,377,042 A * 3/1983 Bauer ..... A43B 13/36 36/15
6,282,818 B1 * 9/2001 Lu ..... A43B 13/14 36/15
6,931,766 B2 * 8/2005 Greene ..... A43B 3/122 36/15
7,111,416 B2 * 9/2006 Gallegos ..... A43B 13/12 36/15
7,210,251 B1 * 5/2007 Rolle ..... A43B 1/0081 36/15
7,234,248 B2 * 6/2007 Kelley ..... A43B 3/122 12/146 BC
7,475,500 B2 * 1/2009 Covatch ..... A43B 7/32 36/91
7,669,352 B2 * 3/2010 Stefani ..... A43B 3/246 36/101
2003/0200676 A1 * 10/2003 Gross ..... A43B 13/20 36/15

(Continued)

*Primary Examiner* — Patrick J. Lynch
*Assistant Examiner* — Brianna T. Duckworth
(74) *Attorney, Agent, or Firm* — Kilpatrick Townsend & Stockton LLP

(57) ABSTRACT

Article of footwear include an upper and an insole that can be easily attach and detached from the upper. An article of footwear includes an upper, an insole, an outsole, and outsole retention fasteners. The upper includes flexible attachment straps. The insole is configured for removable coupling with the upper via the flexible attachment straps. The outsole is configured for removable coupling with the insole via the outsole retention fasteners.

20 Claims, 11 Drawing Sheets

(56) References Cited

U.S. PATENT DOCUMENTS

| | | | | |
|---|---|---|---|---|
| 2003/0230007 | A1* | 12/2003 | Walton | A43B 13/36 36/15 |
| 2008/0072453 | A1* | 3/2008 | Mizrahi | A43B 3/24 36/44 |
| 2008/0098622 | A1* | 5/2008 | Berrins | A43B 3/24 36/11.5 |
| 2013/0227857 | A1* | 9/2013 | Schindler | A43B 13/20 36/83 |
| 2015/0351488 | A1* | 12/2015 | Davis | A43B 23/029 36/88 |
| 2016/0242493 | A1* | 8/2016 | Stillwagon | A43B 3/126 |
| 2018/0184759 | A1* | 7/2018 | Cherneski | A43B 19/00 |

* cited by examiner

SHOE WITH REMOVABLE PARTS

BACKGROUND

Footwear, such as a shoe or a boot, is often subjected to wear inducing ground contact that degrades the outsole of the footwear. Once the outsole is worn beyond an acceptable limit, the footwear is often disposed of even when the upper of the footwear is still in good condition.

The configuration of the sole of an article of footwear is typically based on a design usage of the footwear. For example, the sole of a footwear designed for running will typically be designed to absorb higher ground impact forces as compared to the sole of a dress shoe or work boot. Accordingly, many people own multiple types of footwear based on the range of the types of footwear usage for the particular person.

The influence of the configuration of the sole of an article of footwear on how comfortable the footwear is for a particular user may be significant. While footwear is often available in many sizes, and often widths, the available foot wear may have soles that do not provide optimum comfort for the sizes and shapes of the feet of a particular person.

BRIEF SUMMARY

The following presents a simplified summary of some embodiments of the invention in order to provide a basic understanding of the invention. This summary is not an extensive overview of the invention. It is not intended to identify key/critical elements of the invention nor to delineate the scope of the invention. Its sole purpose is to present some embodiments of the invention in a simplified form as a prelude to the more detailed description that is presented later.

Embodiments described herein are directed to an article of footwear that include an upper with attachment straps and an insole with fastener members configured for removable coupling with the attachment straps for removable coupling of the insole with the upper. The article of footwear includes a replaceable outsole that is secured to the insole using removable fasteners. In many embodiments, the article footwear includes a replaceable midsole that is sandwiched between the outsole and the insole and secured in place by the removable fasteners. The article of footwear provides for easy replacement of the outsole, the midsole, and/or the insole without any specialized skill and/or specialized tools, thereby enabling easy replacement of a worn outsole and/or customization of the article footwear for a particular user and/or usage via the replacement of the outsole, the midsole, the insole, and/or the upper.

Thus, in one aspect, an article of footwear includes an upper, an insole, an outsole, and outsole retention fasteners. The upper includes flexible attachment straps and attachment strap fastener members. Each of the attachment strap fastener members is attached to one of the flexible attachment straps. The insole has an insole upper side and an insole lower side. The insole includes insole first fastener members and insole second fastener members. The insole first fastener members are disposed on the insole lower side. Each of the insole first fastener members is configured for removable coupling with a respective one of the attachment strap fastener members. The insole second fastener members are disposed on the insole lower side. The outsole includes outsole retention through holes. The outsole retention fasteners are configured for removable coupling with the insole second fastener members for removable coupling of the outsole with the insole. Each of the outsole retention through holes is configured to accommodate an outsole portion of one of the outsole retention fasteners.

In some embodiments, the insole includes insole attachment strap recesses disposed on the insole lower side. Each of the insole attachment strap recesses can be sized to accommodate a portion of one of the flexible attachment straps. Each of the insole attachment strap recesses can be further sized to accommodate the attachment strap first coupling member attached to the attachment strap.

Any suitable type of fastener can be used to removably couple the insole to the attachment straps. For example, in some embodiments, hook and loop fasteners are used to removably coupled the insole to the attachment straps. In some embodiments, snap button fasteners are used to removably couple the insole to the attachments straps.

Any suitable type of fastener can be used to removably couple the outsole to the insole. For example, in some embodiments, the insole includes threaded inserts. Each of the insole second fastener members can include one of the threaded inserts. Each of the outsole retention fasteners can include a threaded portion configured for mating with a respective one of the threaded inserts.

In many embodiments, the article of footwear includes a midsole. The midsole can include midsole retention through holes for selective retention of the midsole between the insole and the outsole. Each of the midsole retention through holes can be configured to accommodate a midsole portion of the one of the outsole retention fasteners. In some embodiments, the midsole includes midsole attachment strap recesses. Each of the midsole attachment strap recesses can be sized to accommodate at least a portion of the attachment strap first coupling member attached to one of the flexible attachment straps. Each of the midsole attachment strap recesses can be further sized to accommodate at least a portion of the attachment strap to which the attachment strap first coupling member is attached.

The upper can have any suitable configuration. For example, in some embodiments, the upper includes an inflatable Achilles support bladder. In some embodiments, the upper includes an inflatable toe support bladder. In some embodiments, the upper includes a bottom panel configured to separate a foot wearing the upper from the insole. The upper can include an inflatable Achilles support bladder and an inflation port in fluid communication with the inflatable Achilles support bladder. The upper can include an inflatable toe support bladder and an inflation port in fluid communication with the inflatable toe support bladder. The upper can include an inflatable arch support bladder and an inflation port in fluid communication with the inflatable arch support bladder for inflation of the inflatable arch support bladder. The upper can include an inflatable arch support bladder, an inflatable Achilles support bladder, an inflation connection tube that fluidly couples the inflatable arch support bladder and the inflatable Achilles support bladder, and an inflation port for inflation of the inflatable arch support bladder and the inflatable Achilles support bladder. The upper can include an inflatable toe support bladder, an inflatable arch support bladder, an inflation connection tube that fluidly couples the inflatable toe support bladder and the inflatable arch support bladder, and an inflation port for inflation of the inflatable arch support bladder and the inflatable toe support bladder. The upper can include an inflatable toe support bladder, an inflatable arch support bladder, an inflatable Achilles support bladder, an inflatable outer side surface bladder, one or more inflation connection tubes that fluidly couple the inflation toe support bladder, the inflatable arch support bladder, the inflatable Achilles support bladder, and the inflatable outer side surface bladder, and an inflation port for inflation of the inflatable arch support bladder, the inflatable toe support bladder, the inflatable Achilles support bladder, and the inflatable outer side surface bladder.

In many embodiments, the article of footwear includes a cushion insert configured to provide cushioning between a foot wearing the upper and the insole. In some embodiments, the cushion insert includes an inflatable arch support bladder and an inflation port that is externally accessible to accommodate inflation of the inflatable arch support bladder while the foot wears the article of footwear.

In another aspect, a footwear system includes the article of footwear and a replacement outsole. The replacement outsole is configured for use as a replacement for the outsole. The replacement outsole can include replacement outsole retention through holes. Each of the replacement outsole retention through holes can be configured to accommodate a replacement outsole portion of one of the outsole retention fasteners.

In some embodiments, the footwear system further includes a replacement insole. The replacement insole can be configured for use as a replacement for the insole. The replacement insole can have a replacement insole upper side and a replacement insole lower side. The replacement insole can include replacement insole first fastener members and replacement insole second fastener members. The replacement insole first fastener members are disposed on the replacement insole lower side. Each of the replacement insole first fastener members is configured for removable coupling with a respective one of the attachment strap fastener members. The replacement insole second fastener members are disposed on the replacement insole lower side. The outsole retention fasteners are configured for removable coupling with the replacement insole second fastener members for removable coupling of the replacement outsole with the replacement insole.

In another aspect, a footwear system includes the article of footwear and a replacement upper. The replacement upper is configured for use as a replacement of the upper. The replacement upper includes replacement upper flexible attachment straps and replacement upper attachment strap fastener members. Each of the replacement upper attachment strap fastener members is attached to one of the replacement upper flexible attachment straps. Each of the replacement upper attachment strap fastener members is configured for removable coupling with a respective one of the insole first fastener members. In some embodiments, the replacement upper has a different style than the upper.

For a fuller understanding of the nature and advantages of the present invention, reference should be made to the ensuing detailed description and accompanying drawings.

DETAILED DESCRIPTION

In the following description, various embodiments of the present invention will be described. For purposes of explanation, specific configurations and details are set forth in order to provide a thorough understanding of the embodiments. However, it will also be apparent to one skilled in the art that the present invention may be practiced without the specific details. Furthermore, well-known features may be omitted or simplified in order not to obscure the embodiment being described.

Figure 1:
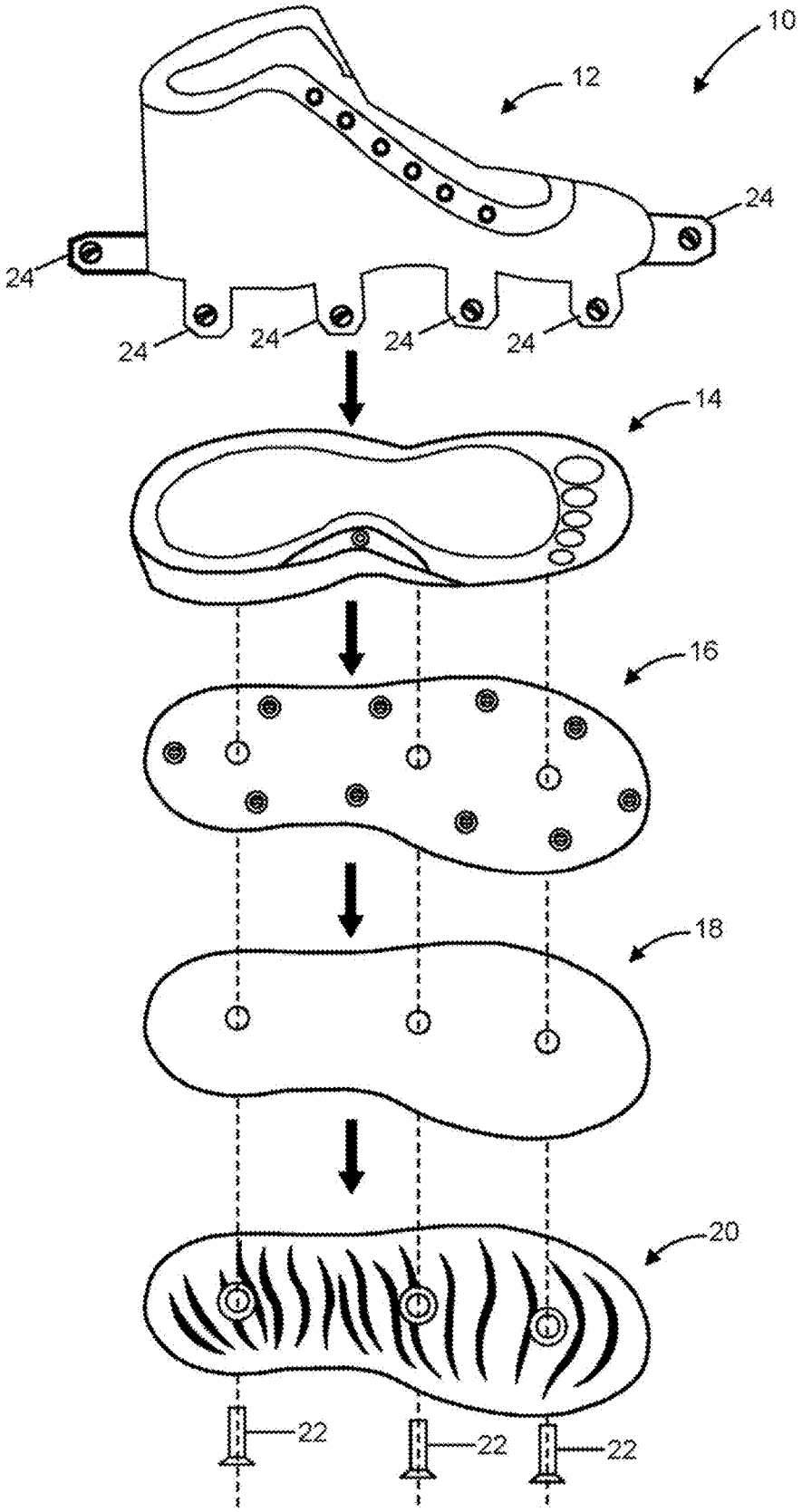
FIG. 1 is an exploded view illustration of an article of footwear that includes an upper with attachment straps and an insole that is removably fastened to the upper via the attachment straps, in accordance with embodiments.

Turning now to the drawing figures, in which like reference numbers refer to like features, FIG. 1 is an exploded view illustration of an article of footwear 10, in accordance with embodiments. The article of footwear 10 includes an upper 12, a cushion insert 14, an insole 16, a midsole 18, an outsole 20, and outsole retention fasteners 22. The article of footwear 10 is configured to accommodate the ability of a person lacking specialized skill with regard to footwear repair and without requiring uncommon specialized footwear repair tools to accomplish: 1) disassembly and separation of the upper 12 from the insole 16, 2) disassembly and separation of the midsole 18 and the outsole 20 from the insole 16 via removal of the outsole retention fasteners 22, 3) reassembly of the upper 12 and the insole 16, and 4) reassembly of the midsole 18 and the outsole 20 with the insole 16 via installation of the outsole retention fasteners 22. The configuration of the article of footwear 10 enables easy replacement any of the upper 12, the cushion insert 14, the insole 16, the midsole 18, the outsole 20, and/or the outsole retention fasteners 22, thereby enabling replacement of these components when worn-out and/or with different configurations and/or styles of these components for customization of the article of footwear 10.

Figure 2:
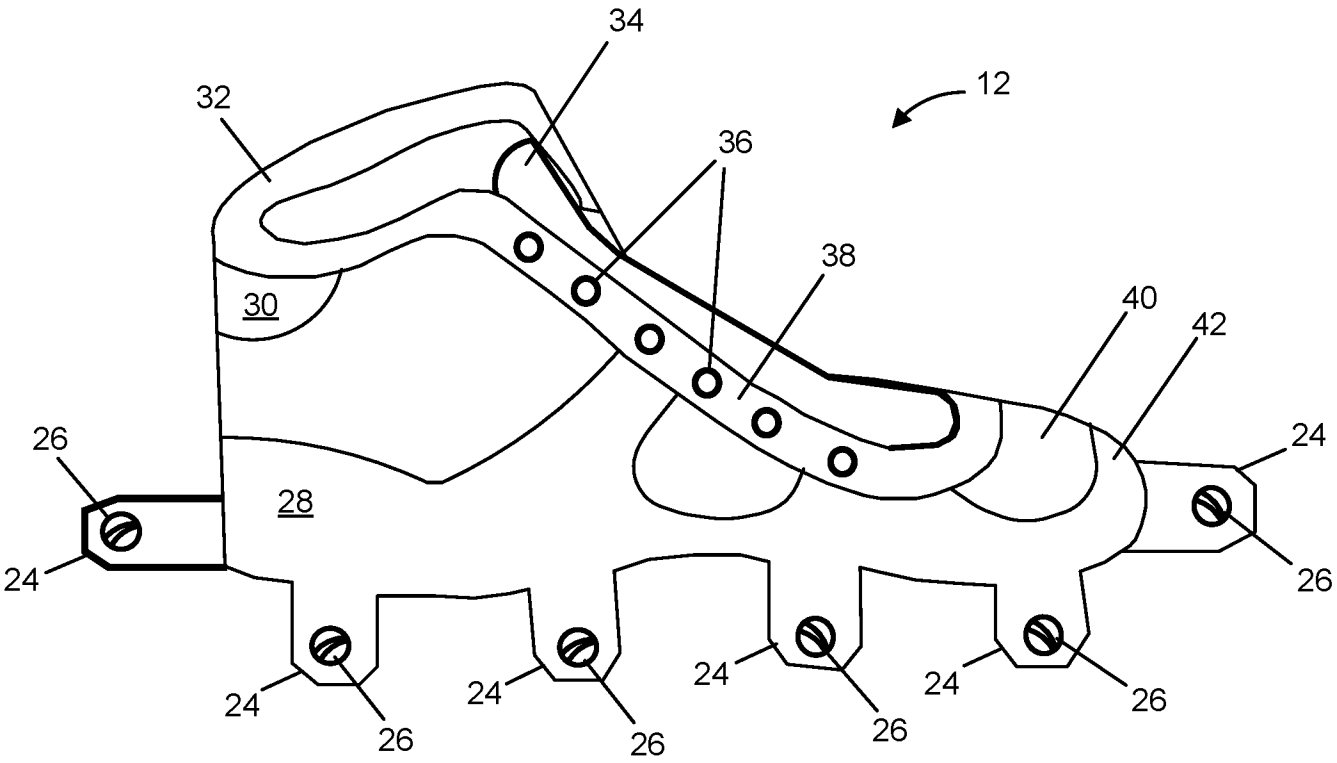
FIG. 2 is a side view illustration of the upper of the article of footwear of FIG. 1.
Figure 3:
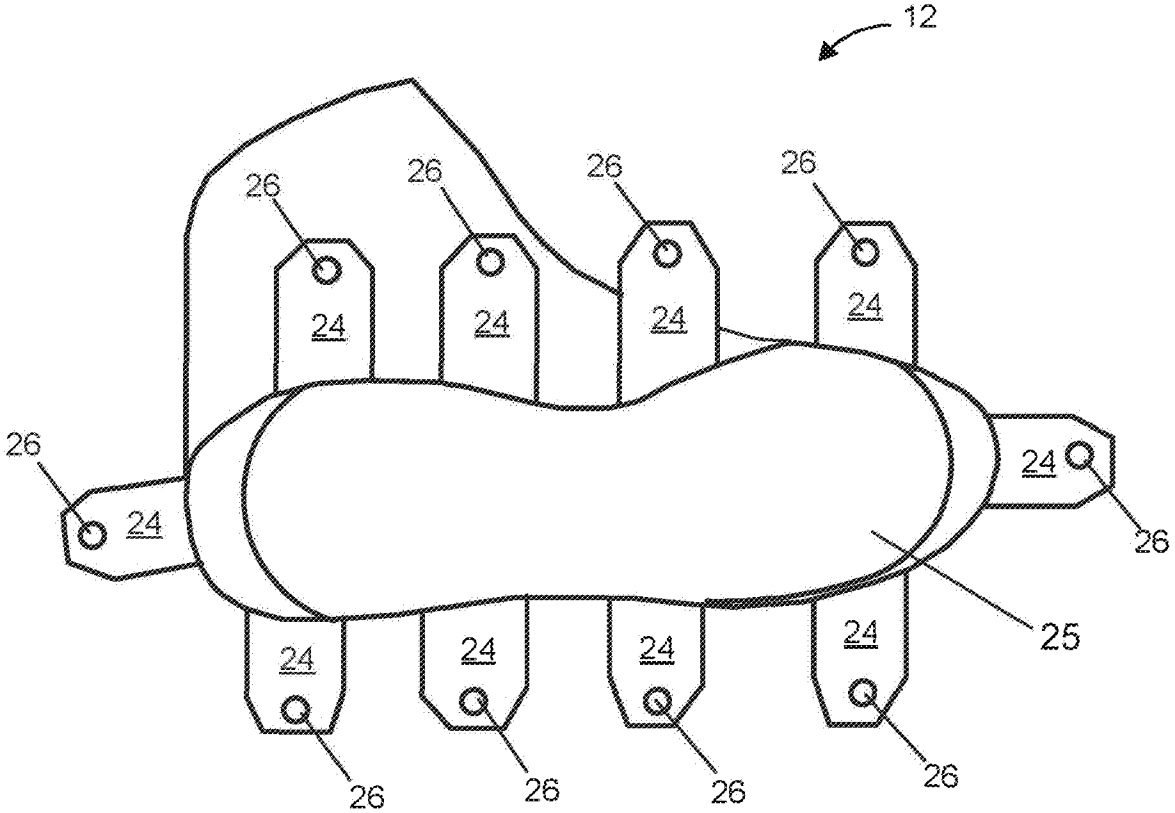
FIG. 3 is a bottom view illustration of the upper of the article of footwear of FIG. 1.

FIG. 2 shows a side view illustration of the upper 12. The upper 12 includes attachment straps 24 distributed around a bottom perimeter of the upper 12 and extending from the bottom perimeter. An attachment strap fastener member 26 is attached to each of the attachment straps 24. In addition to the attachment straps 24 and the attachment strap fastener members 26, the upper 12 can include any suitable features. For example, in the illustrated embodiment, the upper 12 further includes a heel counter 28, a heel tab 30, a collar 32, a tongue 34, eyelets 36, an eyestay 38, a toe vamp 40, and a toe cap 42. FIG. 3 is a bottom view illustration of the upper 12. In some embodiments, the upper 12 may include a bottom panel 25. The bottom panel 25 may be configured to separate a foot wearing the upper 12 from the insole 16.

Figure 4:
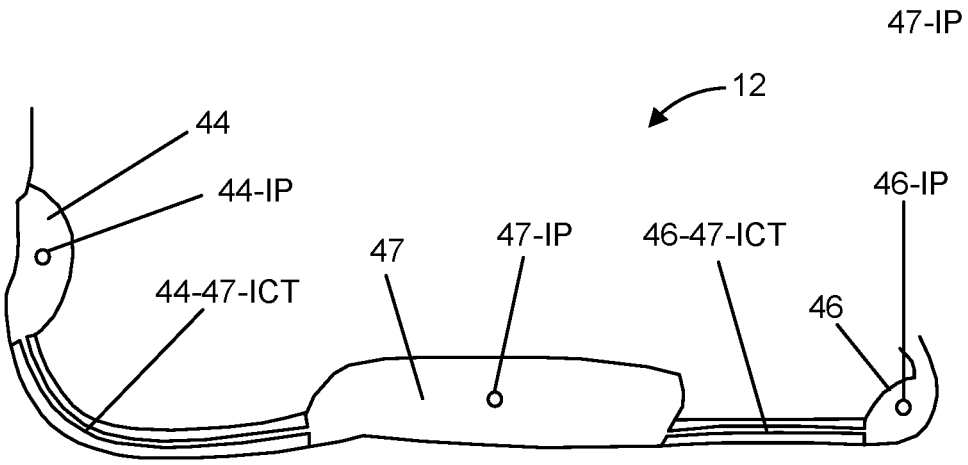
FIG. 4 is a side view illustration of aspects of embodiments the upper of the article of footwear of FIG. 1.
Figure 5:
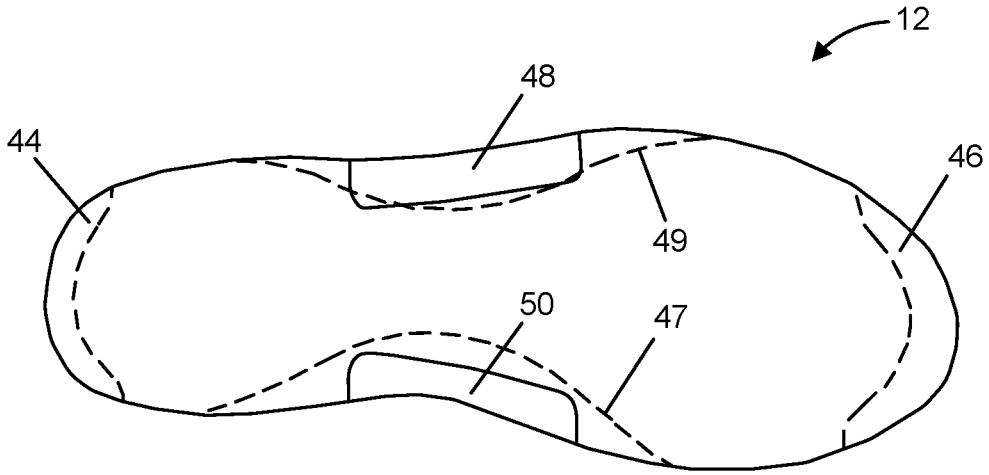
FIG. 5 is a top view illustration of aspects of embodiments the upper of the article of footwear of FIG. 1.

FIG. 4 and FIG. 5 illustrate additional features of some embodiments of the upper 12. FIG. 4 and FIG. 5 show an embodiment of the upper 12 that includes an inflatable Achilles support bladder 44, an inflatable toe support bladder 46, an inflatable arch support bladder 47, and reinforcement members 48, 50. The upper 12 can include an externally accessible Achilles support bladder inflation port 44-IP in fluid communication with the Achilles support bladder 44 to accommodate inflation of the Achilles support bladder 44 while the footwear 10 is being worn. The upper 12 can include an externally accessible toe support bladder inflation port 46-IP in fluid communication with the toe support bladder 46 to accommodate inflation of the toe support bladder 46 while the article of footwear 10 is being worn. The upper 12 can include an externally accessible arch support bladder inflation port 47-IP in fluid communication with the arch support bladder 47 to accommodate inflation of the arch support bladder 47 while the article of footwear 10 is being worn.

The upper 12 can include one or more inflation connection tubes that are connected with any suitable combination of the Achilles support bladder 44, the toe support bladder 46, and the arch support bladder 47. For example, the embodiment of the upper 12 illustrated in FIG. 4 includes an inflation connection tube 44-47-ICT and an inflation connection tube 46-47-ICT. The Achilles support bladder 44 and the arch support bladder 47 are in fluid communication through the inflation connection tube 44-47-ICT. The toe support bladder 46 and the Achilles support bladder 47 are in fluid communication through the inflation connection tube 46-47-ICT. The inflation connection tubes 44-47-ICT, 46-47-ICT enable simultaneous inflation of the Achilles support bladder 44, the toe support bladder 46, and the arch support bladder 47 through one of the Achilles support bladder inflation port 44-IP, the toe support bladder inflation port 46-IP, or the arch support bladder inflation port 47-IP.

The upper 12 can include any suitable combination of one or more inflation connection tubes and one or more support bladder inflation ports. For example, the upper 12 can include the inflation connection tube 44-47-ICT in combination with the Achilles support bladder inflation port 44-IP and/or the arch support bladder inflation port 47-IP. The upper 12 can include the inflation connection tube 46-47-ICT in combination with the Achilles support bladder inflation port 44-IP and/or the toe support bladder inflation port 46-IP. The upper 12 can include the inflation connection tube 44-47-ICT and the inflation connection tube 46-47-ICT in combination with one or more of the Achilles support bladder inflation port 44-IP, the toe support bladder inflation port 46-IP, and the arch support bladder inflation port 47-IP. The toe support bladder 46 and the Achilles support bladder 44 can be in fluid communication via an inflation connection tube that is not connected with the arch support bladder 47.

The upper 12 can further include an inflatable outer side surface bladder 49 that can be inflated to adjust the fit between the outer side portion of the upper 12 and the outer side portion of the wearer's foot. The inflatable outer side surface bladder 49 can have inflation port and/or can be in fluid connection with any combination of the Achilles support bladder inflation port 44-IP, the toe support bladder inflation port 46-IP, and the arch support bladder inflation port 47-IP via any suitable one or more inflation connection tubes.

Figure 6:
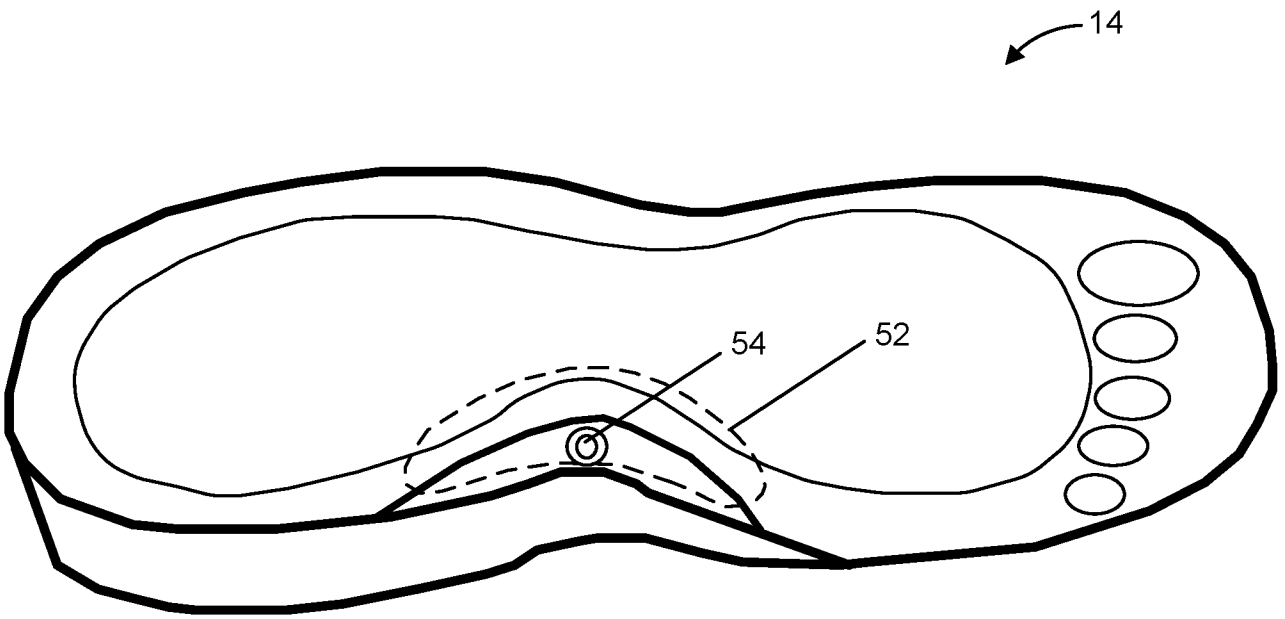
FIG. 6 shows a cushion insert of the article of footwear of FIG. 1.

FIG. 6 shows the cushion insert 14 of the article of footwear 10. The cushion insert 14 can have any suitable configuration. For example, the cushion insert 14 can be made from any suitable impact absorbing material(s) and have any suitable distribution of thickness. In the illustrated embodiment, the cushion insert 14 includes an inflatable arch support bladder 52 and an arch support bladder inflation port 54 via which the arch support bladder 52 can be inflated and deflated.

Figure 7:
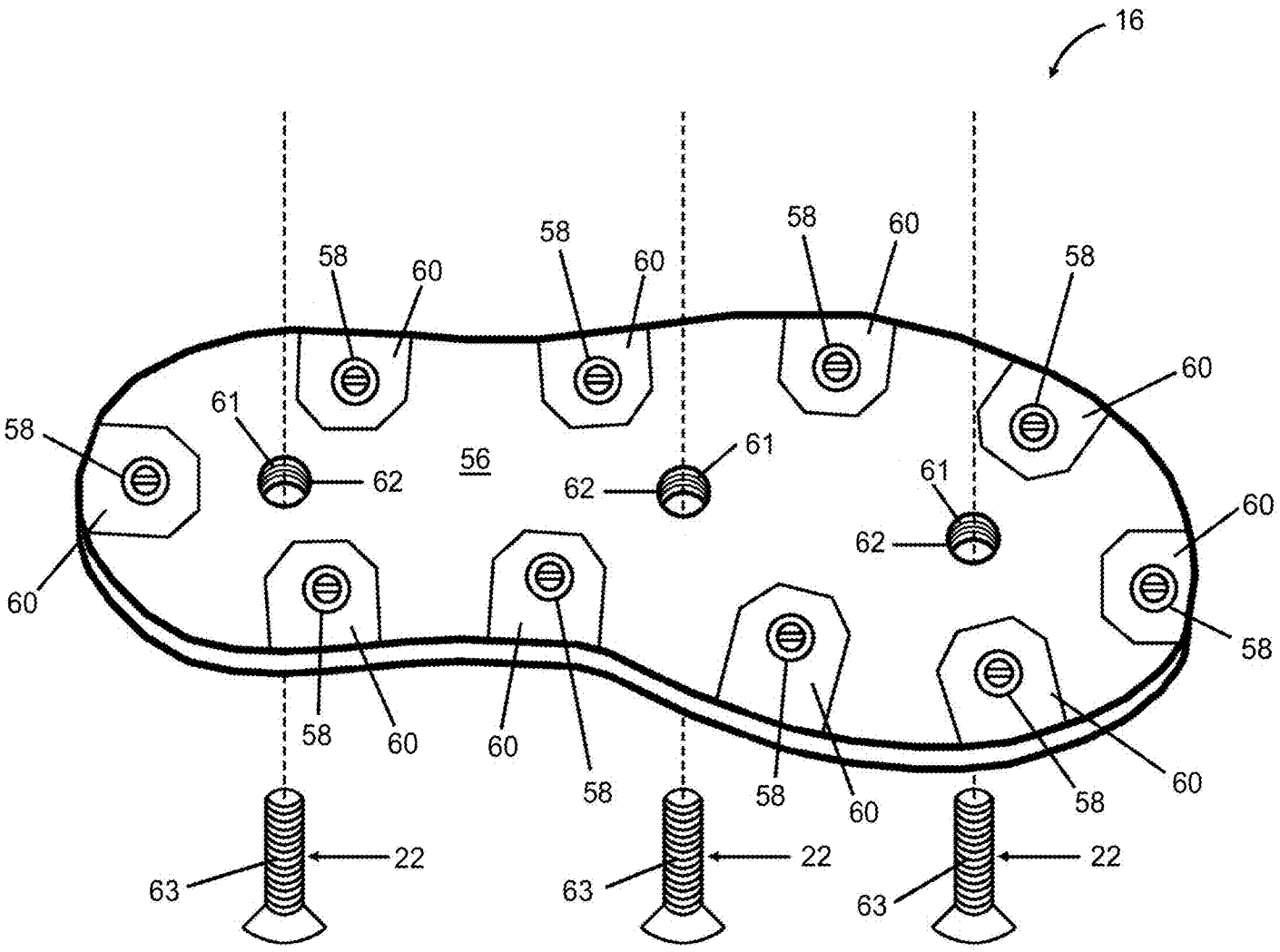
FIG. 7 is a bottom view illustration of the insole of the article of footwear of FIG. 1.

FIG. 7 shows an insole lower surface 56 of the insole 16 of the article of footwear 10. In the illustrated embodiment, the insole 16 includes insole first fastener members 58, insole attachment strap recesses 60, and an insole second fastener members 62. The insole first fastener members 58 are attached to the lower side of the insole 16. Each of the insole first fastener members 58 is configured and positioned for coupling with a respective one of the attachment strap fastener members 26 to secure the insole 16 to the upper 12 via the attachment straps 24. Each of the attachment straps 24 is configured to wrap around a respective perimeter portion of the insole 16 and interface with a portion of the insole lower surface 56 surrounding the associated insole first fastener member 58. In the illustrated embodiment, each of the insole attachment strap recesses 60 has a depth selected to accommodate a suitable thickness of the respective attachment strap 24 so that the portion of the attachment strap 24 disposed between the insole lower surface 56 and the midsole 18 is subjected to suitable clamping forces applied via the attachment of the midsole 18 and the outsole 20 to the insole 16 via the outsole retention fasteners 22. The insole second fastener members 62 are exposed on the lower side of the insole 16. Each of the insole second fastener members 62 is configured and positioned for coupling with a respective one of the outsole retention fasteners 22 to secure the midsole 18 and the outsole 20 to the insole 16. In the illustrated embodiment, each of the insole second fastener members 62 comprises a female threaded insert 61 and each of the outsole installation fasteners 22 comprises a male threaded length 63 configured for rotational coupling with a respective one of the female threaded inserts 61.

Figure 8:
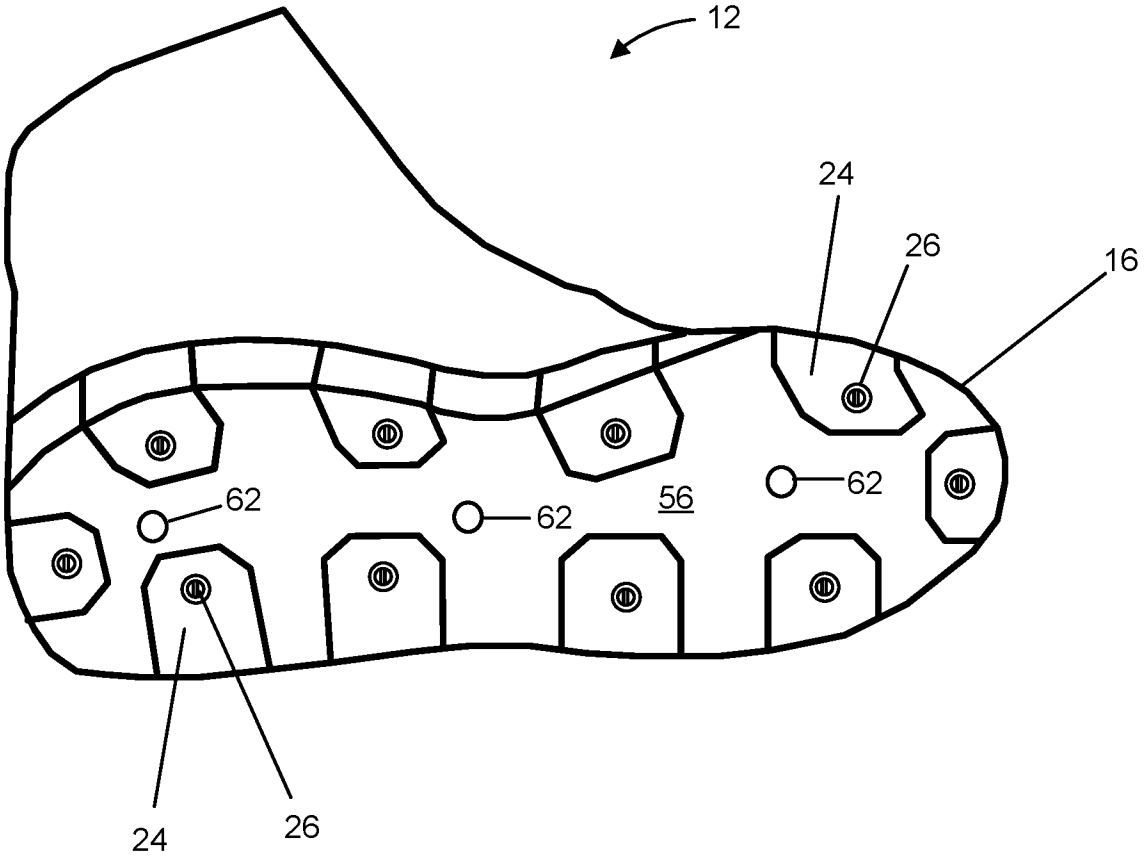
FIG. 8 is a bottom view illustration of the insole coupled with the upper of the article of footwear of FIG. 1.

FIG. 8 shows the insole 16 coupled with the upper 12 via the attachment straps 24. Each of the attachment straps 24 wraps around a respective perimeter portion of the insole 16 and interfaces with a respective portion of the insole lower surface 56. In many embodiments, each of the attachment straps 24 includes suitable upper and lower exterior abrasion resistant fabric layers to increase the abrasion resistance of the attachment strap 24 against abrasion from relative movement between the attachment strap 24 and the interfacing portions of the insole 16 and from abrasion arising from contact of the attachment strap 24 with external items. With the insole 16 coupled with the upper 12 via the attachment straps 24, the midsole 18 and the outsole 20 can be coupled with the insole 18 via installation of the outsole retention fasteners 22.

Figure 9:
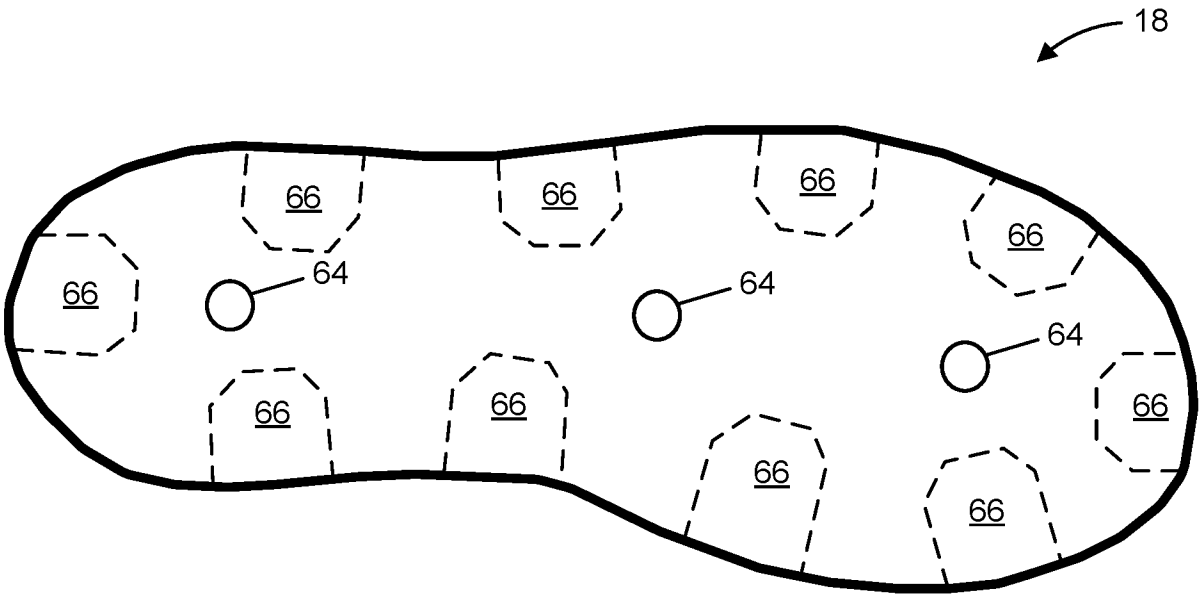
FIG. 9 is a bottom view illustration of a midsole of the article of footwear of FIG. 1.
Figure 10:
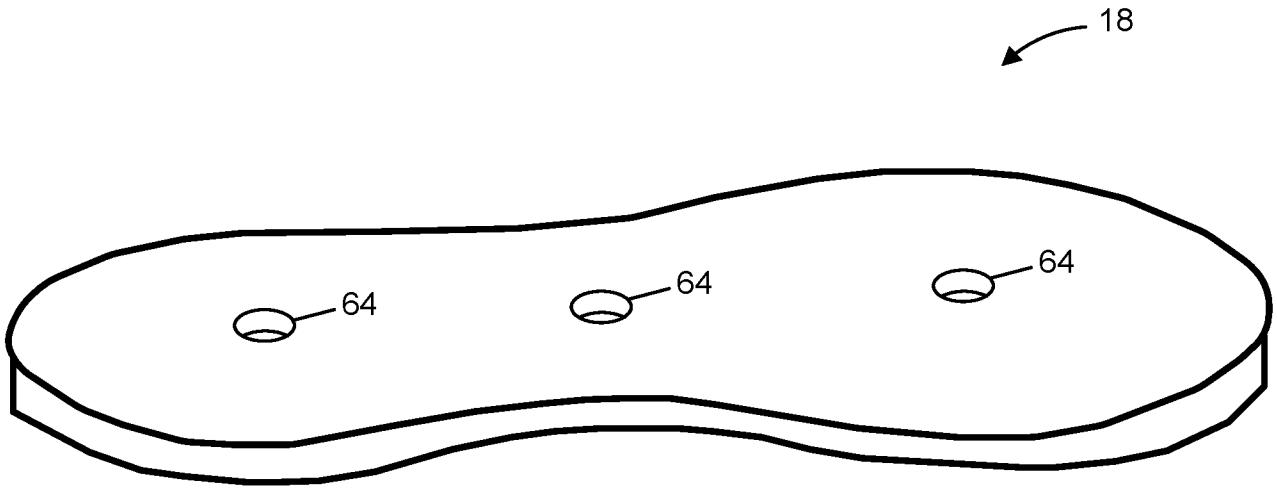
FIG. 10 shows another view of the midsole of the article of footwear of FIG. 1.

FIG. 9 shows a bottom view of the midsole 18 of the article of footwear 10. FIG. 10 shows an oblique view of the midsole 18. The midsole 18 includes midsole retention through holes 64 and midsole attachment strap recesses 66 disposed in the upper side of the midsole 18. The midsole retention through holes 64 are configured for retention of the midsole 18 to the insole 16 via the outsole retention fasteners 22. In the illustrated embodiment, each of the midsole attachment strap recesses 66 has a depth selected to accommodate a suitable thickness of the respective attachment strap 24 so that the portion of the attachment strap 24 disposed between the insole lower surface 56 and the midsole 18 is subjected to suitable clamping forces applied via the attachment of the midsole 18 and the outsole 20 to the insole 16 via the outsole retention fasteners 22. Each of the midsole retention through holes 64 is configured to accommodate a midsole portion of one of the outsole retention fasteners 22. While the illustrated embodiment of the midsole 18 has a relatively constant thickness, the midsole 18 can have any suitable distribution of thicknesses and/or material(s).

Figure 11:
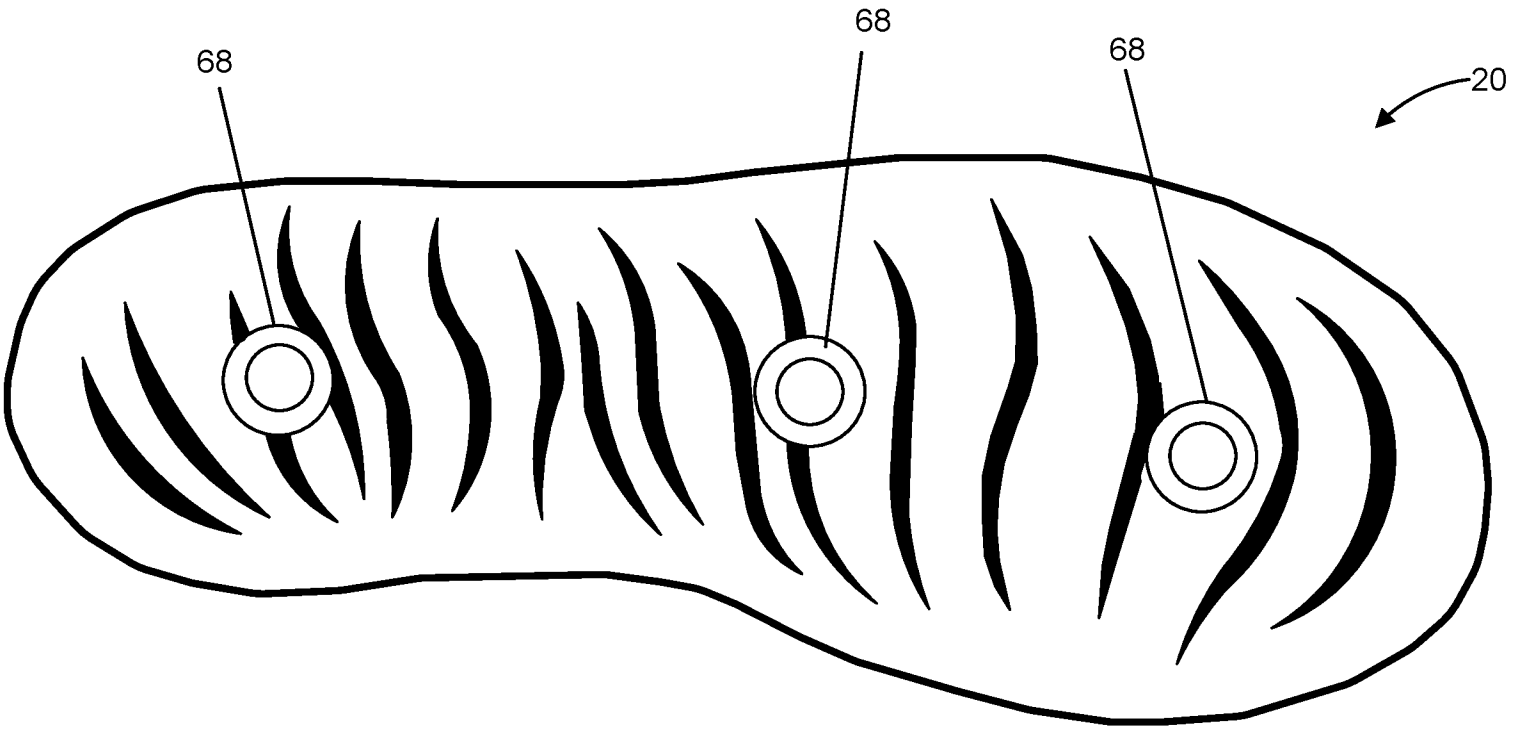
FIG. 11 is a bottom view illustration of an outsole of the article of footwear of FIG. 1.

FIG. 11 shows a bottom view of the outsole 20 of the article of footwear 10. The outsole 20 includes countersunk outsole retention through holes 68 for retention of the outsole 20 to the insole 16. Each of the outsole retention through holes 68 is configured to accommodate an outsole portion of one of the outsole retention fasteners 22. The outsole 20 can have any suitable distribution of thicknesses and/or materials. The outsole retention fasteners 22 can have suitable recessed heads that are accommodated in the countersinks of the outsole retention through holes 68.

Figure 12:
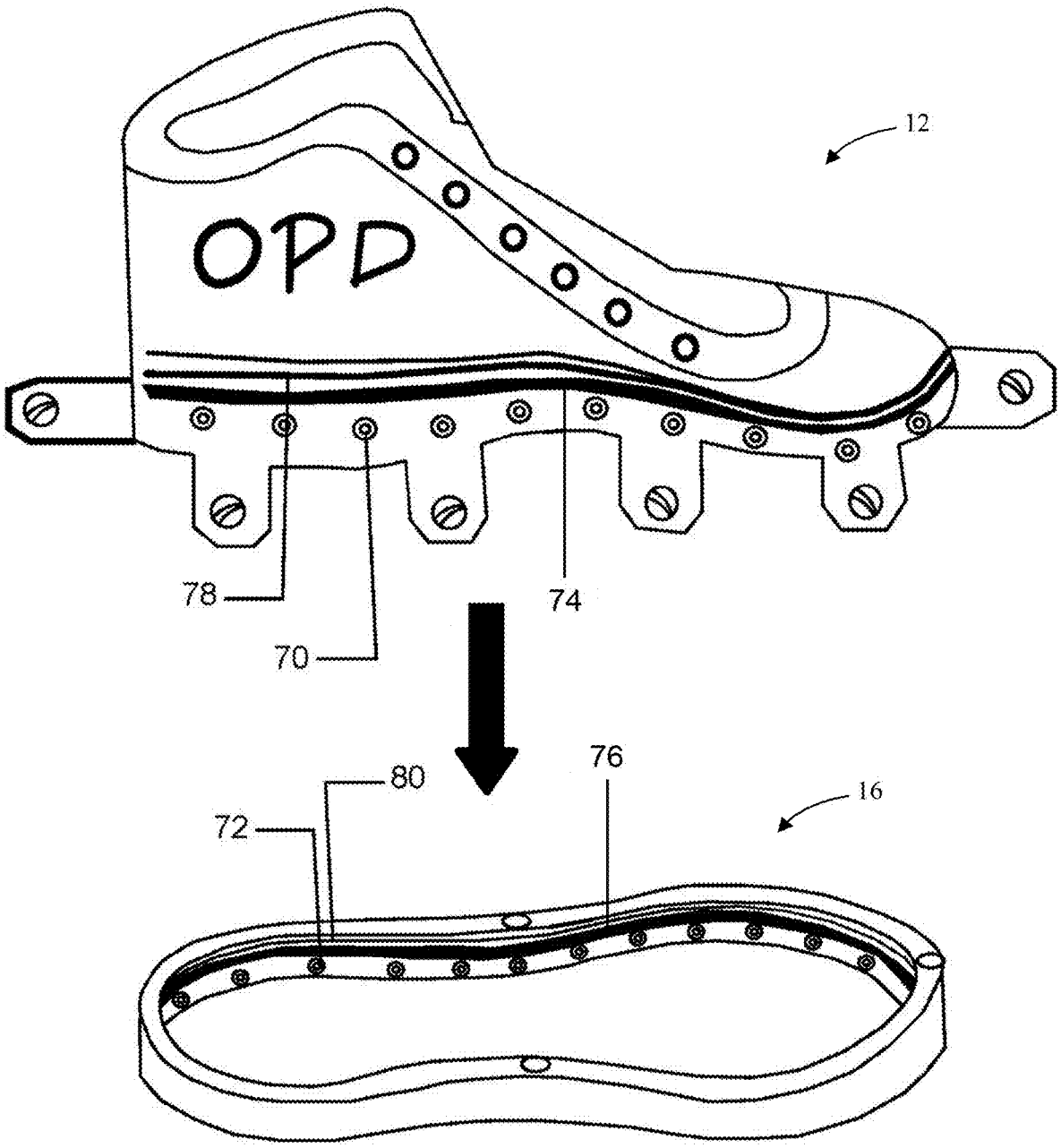
FIG. 12 illustrates example fastening systems that can be used to couple the upper and the insole of the article of footwear of FIG. 1.

FIG. 12 illustrates example fastening systems that can be used to couple the upper 12 and the insole 16. A first example fastening system employs button fasteners 70, 72. The button fasteners 70 are distributed around a lower perimeter of the upper 12 and positioned to mate with the button fasteners 72, which are distributed around an inner perimeter surface of the insole 16. A second example fastening system employs hook-and-loop strip fasteners 74, 76. The hook-and-loop strip fasteners 74 extend around a lower perimeter of the upper 12 and positioned to mate with the hook-and-loop fasteners 76, which extend around an inner perimeter surface of the insole 16. The third example fastening system employs plastic-zipper fasteners 78, 80, which can be configured similar to plastic-zipper fasteners used on known res-sealable plastic bags. The plastic-zipper fasteners 78 extend around a lower perimeter of the upper 12 and positioned to mate with the plastic-zipper fasteners 80, which extend around an inner perimeter surface of the insole 16. The footwear 10 can employ any suitable combination of the first, second, and third example fastening systems, such as only the first example fastening system, only the second example fastening system, only the third example fastening system, both the first and second example fastening systems, both the first and third example fastening systems, both the second and third example fastening systems.

The article of footwear 10 provides for easy replacement of the outsole 20, the midsole 18, and/or the insole 16 without any specialized skill and/or specialized tools. Accordingly, any worn out component of the article of footwear 10 (e.g., the upper 12, the insert 14, the insole 16, the midsole 18, the outsole 20, the outsole retention fasteners 22) can be easily replaced in a do-it-yourself manner. The article of footwear 10 can also be easily customized for a particular user and/or usage via the replacement of the outsole 20, the midsole 18, the insole 16, and/or the upper 12.

Other variations are within the spirit of the present invention. Thus, while the invention is susceptible to various modifications and alternative constructions, certain illustrated embodiments thereof are shown in the drawings and have been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

All references, including publications, patent applications, and patents, cited herein are hereby incorporated by reference to the same extent as if each reference were individually and specifically indicated to be incorporated by reference and were set forth in its entirety herein.

What is claimed is:

1. An article of footwear comprising:

an upper comprising a bottom panel, flexible attachment straps, and attachment strap fastener members, wherein each of the attachment strap fastener members is attached to one of the flexible attachment straps;

an insole configured for removable coupling with the upper, wherein the insole has an insole upper side and an insole lower side, wherein the insole comprises insole first fastener members and insole second fastener members, wherein the insole first fastener members are disposed on the insole lower side, and wherein each of the insole first fastener members is configured for removable coupling with a respective one of the attachment strap fastener members of a respective one of the flexible attachment straps;

an outsole comprising outsole retention through holes;

outsole retention fasteners comprising a head portion and a through hole portion and configured for removable coupling with the insole second fastener members for removable coupling of the outsole with the insole, wherein each of the outsole retention through holes includes a head portion recess configured to accommodate the head portion of one of the outsole retention fasteners; and first hook and loop fasteners and second hook and loop fasteners, wherein the first hook and loop fasteners are attached to and extend around a lower perimeter of the upper, and wherein the insole further comprises a sidewall extending upward around a perimeter of the insole, the sidewall having an inner perimeter surface, and wherein the second hook and loop fasteners are attached to the insole, extend around the inner perimeter surface of the sidewall of the insole, and are positioned to mate with the first hook and loop fasteners.

2. The article of footwear of claim 1, further comprising a cushioned insert configured for removable coupling with the upper and the insole to be disposed between the bottom panel and the insole with the flexible attachment straps distributed around the cushioned insert.

3. An article of footwear comprising:

an upper comprising a bottom panel, flexible attachment straps, and attachment strap fastener members, wherein each of the attachment strap fastener members is attached to one of the flexible attachment straps;

an insole configured for removable coupling with the upper, wherein the insole has a perimeter, an insole upper side and an insole lower side, wherein the insole comprises insole first fastener members and insole second fastener members, wherein the insole first fastener members are disposed on the insole lower side, and wherein each of the insole first fastener members is configured for removable coupling with a respective one of the attachment strap fastener members of a respective one of the flexible attachment straps, wherein the insole further comprises a sidewall extending upward around the perimeter of the insole, the sidewall having an inner perimeter surface;

an outsole comprising outsole retention through holes;

outsole retention fasteners comprising a head portion and a through hole portion and configured for removable coupling with the insole second fastener members for removable coupling of the outsole with the insole, wherein each of the outsole retention through holes includes a head portion recess configured to accommodate the head portion of one of the outsole retention fasteners; and at least one of:

upper button fasteners and insole button fasteners, wherein the upper button fasteners extend around a lower perimeter of the upper, and wherein the insole button fasteners are distributed around the inner perimeter surface of the sidewall of the insole and configured for detachable coupling with the upper button fasteners;

upper hook-and-loop fasteners and insole hook-and-loop fasteners, wherein the upper hook-and-loop fasteners extend around the lower perimeter of the upper, and wherein the insole hook-and-loop fasteners are distributed around the inner perimeter surface of the sidewall of the insole and configured for detachable coupling with the upper hook-and-loop fasteners; or upper plastic-zipper fasteners and insole plastic-zipper fasteners, wherein the upper plastic-zipper fasteners extend around the lower perimeter of the upper, and wherein the insole plastic-zipper fasteners are distributed around the inner perimeter surface of the sidewall of the insole and configured for detachable coupling with the upper plastic-zipper fasteners.

4. The article of footwear of claim 3, wherein:

the insole comprises insole attachment strap recesses disposed on the insole lower side, and each of the insole attachment strap recesses is sized to accommodate one of the flexible attachment straps.

5. The article of footwear of claim 3, wherein the attachment strap fastener members and the insole first fastener members are snap button fasteners.

6. The article of footwear of claim 3, wherein:

the insole comprises threaded inserts;

each of the insole second fastener members comprises one of the threaded inserts; and each of the outsole retention fasteners comprises a threaded portion configured for mating with a respective one of the threaded inserts.

7. The article of footwear of claim 3, further comprising a midsole comprising midsole retention through holes for selective retention of the midsole between the insole and the outsole, wherein each of the midsole retention through holes is configured to accommodate a midsole portion of one of the outsole retention fasteners.

8. The article of footwear of claim 7, wherein:

the midsole comprises midsole attachment strap recesses, and each of the midsole attachment strap recesses is sized to accommodate at least a portion of an attachment strap fastener member of the attachment strap fastener members.

9. The article of footwear of claim 8, wherein each of the midsole attachment strap recesses is further sized to accommodate at least a portion of one of the flexible attachment straps to which the attachment strap fastener member is attached.

10. The article of footwear of claim 3, wherein the upper comprises an inflatable Achilles support bladder and an inflation port in fluid communication with the inflatable Achilles support bladder.

11. The article of footwear of claim 3, wherein the upper comprises an inflatable toe support bladder and an inflation port in fluid communication with the inflatable toe support bladder.

12. The article of footwear of claim 3, wherein the upper comprises an inflatable arch support bladder and an inflation port in fluid communication with the inflatable arch support bladder for inflation of the inflatable arch support bladder.

13. The article of footwear of claim 3, wherein the upper comprises an inflatable arch support bladder, an inflatable Achilles support bladder, an inflation connection tube that fluidly couples the inflatable arch support bladder and the inflatable Achilles support bladder, and an inflation port for inflation of the inflatable arch support bladder and the inflatable Achilles support bladder.

14. The article of footwear of claim 3, wherein the upper comprises an inflatable toe support bladder, an inflatable arch support bladder, an inflation connection tube that fluidly couples the inflatable toe support bladder and the inflatable arch support bladder, and an inflation port for inflation of the inflatable arch support bladder and the inflatable toe support bladder.

15. The article of footwear of claim 3, wherein the upper comprises:

an inflatable toe support bladder;

an inflatable arch support bladder;

an inflatable Achilles support bladder;

an inflatable outer side surface bladder;

one or more inflation connection tubes that fluidly couple the inflatable toe support bladder, the inflatable arch support bladder, the inflatable Achilles support bladder, and the inflatable outer side surface bladder; and an inflation port for inflation of the inflatable arch support bladder, the inflatable toe support bladder, the inflatable Achilles support bladder, and the inflatable outer side surface bladder.

16. The article of footwear of claim 3, further comprising a cushioned insert configured for removable coupling with the upper and the insole to be disposed between the bottom panel and the insole with the flexible attachment straps distributed around the cushioned insert.

17. A footwear system comprising:

the article of footwear of claim 3; and a replacement outsole configured for use as a replacement for the outsole and comprising replacement outsole retention through holes, wherein each of the replacement outsole retention through holes is configured to accommodate a replacement head portion of one of the outsole retention fasteners.

18. The footwear system of claim 17, further comprising a replacement insole configured for use as a replacement for the insole, wherein the replacement insole has a replacement insole upper side and a replacement insole lower side, wherein the replacement insole comprises replacement insole first fastener members and replacement insole second fastener members, wherein the replacement insole first fastener members are disposed on the replacement insole lower side, wherein each of the replacement insole first fastener members is configured for removable coupling with a respective one of the attachment strap fastener members, wherein the replacement insole second fastener members are disposed on the replacement insole lower side, and wherein the outsole retention fasteners are configured for removable coupling with the replacement insole second fastener members for removable coupling of the replacement outsole with the replacement insole.

19. A footwear system comprising:

the article of footwear of claim 3; and a replacement upper configured for use as a replacement of the upper and comprising replacement upper flexible attachment straps and replacement upper attachment strap fastener members, wherein each of the replacement upper attachment strap fastener members is attached to one of the replacement upper flexible attachment straps, and wherein each of the replacement upper attachment strap fastener members is configured for removable coupling with a respective one of the insole first fastener members.

20. The footwear system of claim 19, wherein the replacement upper has a different style than the upper.

* * * * *